US007562474B2

(12) United States Patent
Voitchovsky

(10) Patent No.: US 7,562,474 B2
(45) Date of Patent: Jul. 21, 2009

(54) IRONING SYSTEM

(75) Inventor: Serge Voitchovsky, Mézières (CH)

(73) Assignee: Laurstar S.A., Chalet- St-Denis (CH)

( * ) Notice: Subject to any disclaimer, the term of this patent is extended or adjusted under 35 U.S.C. 154(b) by 126 days.

(21) Appl. No.: 11/883,882

(22) PCT Filed: Feb. 10, 2006

(86) PCT No.: PCT/IB2006/050447

§ 371 (c)(1),
(2), (4) Date: Sep. 5, 2007

(87) PCT Pub. No.: WO2006/085285

PCT Pub. Date: Aug. 17, 2006

(65) Prior Publication Data

US 2008/0244938 A1 Oct. 9, 2008

(30) Foreign Application Priority Data

Feb. 11, 2005 (EP) ..... 05101042

(51) Int. Cl.
*D06F 75/26* (2006.01)
*G01B 7/16* (2006.01)
*D06F 75/32* (2006.01)

(52) U.S. Cl. ..... 38/77.7; 38/90; 219/248; 219/250; 33/501

(58) Field of Classification Search ..... 38/74, 38/75, 77.7–77.83, 88, 90; 219/248, 250, 219/256, 506; 73/862.044; 33/700, 710, 33/716, 501, 501.6
See application file for complete search history.

(56) References Cited

U.S. PATENT DOCUMENTS

| | | | | |
|---|---|---|---|---|
| 4,705,271 | A * | 11/1987 | Mondloch et al. | 482/112 |
| 5,042,179 | A * | 8/1991 | van der Meer | 38/77.83 |
| 5,642,579 | A * | 7/1997 | Netten et al. | 38/77.7 |
| 5,831,596 | A * | 11/1998 | Marshall et al. | 345/161 |
| 6,720,537 | B2 * | 4/2004 | Prager | 219/506 |
| 7,437,954 | B2 * | 10/2008 | Sakano | 73/862.044 |
| 2002/0029498 | A1 * | 3/2002 | Harrison et al. | 38/75 |
| 2006/0086712 | A1 * | 4/2006 | Feldmeier | 219/250 |

FOREIGN PATENT DOCUMENTS

| | | |
|---|---|---|
| EP | 0 750 066 A1 | 12/1996 |
| WO | WO82/03520 | 10/1982 |

OTHER PUBLICATIONS

English Translation of Written Opinion of the International Searching Authority.
International Search Report mailed Jun. 7, 2006 in PCT/IB2006/050447.

* cited by examiner

*Primary Examiner*—Ismael Izaguirre
(74) *Attorney, Agent, or Firm*—Nixon & Vanderhye P.C.

(57) ABSTRACT

A clothes iron comprising a sole plate (2) and a handle (1), characterized in that said handle (1) comprises a first strain gauge (3) arranged in a direction approximately parallel to the plane defined by the sole plate (2) and a second strain gauge (4) arranged in a direction forming an acute angle with the plane defined by the sole plate (2), said angle being open toward the front of the iron, in such a way that any movement of the iron activates at least one of said strain gauges (3, 4).

8 Claims, 1 Drawing Sheet

FIG.
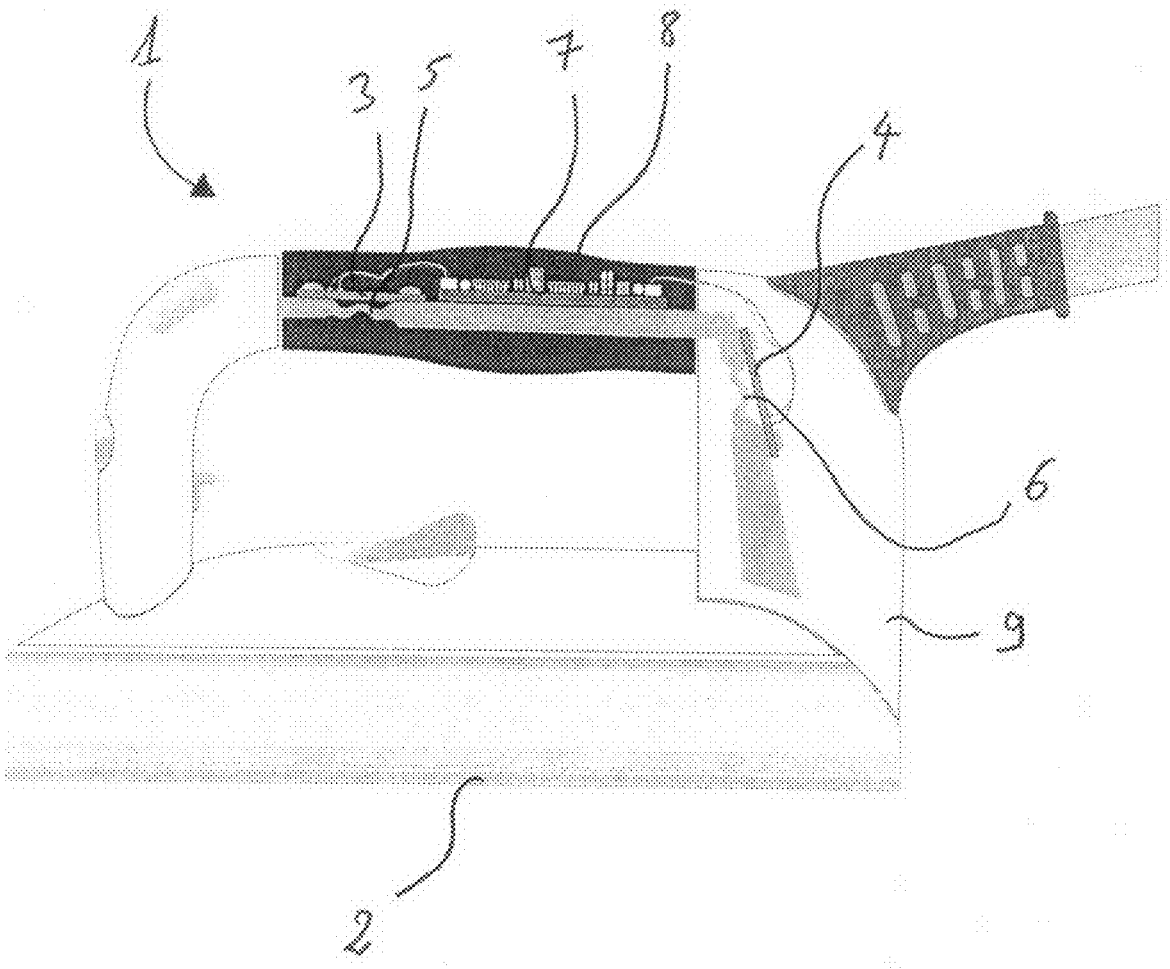

IRONING SYSTEM

This application is the U.S. national phase of international application PCT/IB2006/050447 filed 10 Feb. 2006 which designated the U.S. and claims benefit of EP 05101042.9, dated 11 Feb. 2005, the entire content of which is hereby incorporated by reference.

FIELD OF THE INVENTION

The field of the invention is ironing and more precisely clothes irons equipped with sensors capable of detecting various parameters such as temperature or the presence of a user. The invention relates in particular to ironing systems comprising a clothes iron, an ironing surface, and a fan located underneath the ironing surface in order to apply a positive and/or negative pressure to a fabric laid on the ironing surface, fan activation being controlled through the iron.

PRIOR ART

An ironing system such as that described above is disclosed in European patent EP 0750066 B1.

The prior art also includes clothes irons equipped with sensors capable of detecting various parameters. An example that may be cited is European patent application EP 0 390 264 A1 which discloses a movement sensor. When the sensor is deactivated, that is, when the iron is at rest, steam production stops.

GENERAL DESCRIPTION OF THE INVENTION

One of the problems addressed by the present invention is that of sensing the movements of the iron with a very good degree of reliability.

In the invention, the solution to the above problem is to place two strain gauges on the handle of the iron. The first strain gauge must be arranged in a direction approximately parallel to the plane defined by the sole plate while the second strain gauge must be arranged in a direction forming an acute angle with the plane defined by the sole plate, said angle being open toward the front of the iron. By arranging the strain gauges in this way, any movement of the iron will activate at least one strain gauge.

In one embodiment of the invention, the handle is made more flexible at the positions where the strain gauges are located. Detection of movements of the iron is thus improved.

In another embodiment of the invention, the iron is used with a system for applying positive/negative pressure.

The system advantageously comprises a steam generator connected to at least one gauge.

In a particularly good configuration, the fan starts as soon as the iron is grasped and steam is produced only when the iron is advancing.

When referring to the production of steam, the meaning is either that steam is generated in a steam generator, or that steam is emitted through the sole plate of the iron.

DETAILED DESCRIPTION OF THE INVENTION

The invention is described below in more detail with the aid of an example illustrated in one FIGURE.

The FIGURE shows a clothes iron comprising a sole plate 2 and a handle 1. On its horizontal part, the handle 1 comprises a region of greater flexibility 5 on which a first strain gauge 3 is located.

Another region of greater flexibility 6 is located in the rear vertical part of the handle 9. A second strain gauge 4 is arranged in this other region 6, these two elements being arranged in a direction forming an acute angle with the plane of the sole plate 2. The angle is open toward the front of the iron.

The two gauges 3,4 are connected to an electronic circuit 7 located on a horizontal part of the handle. The electronic circuit 7 in turn is connected to a fan (not shown) and, as an accessory, to a steam generator (not shown).

The two gauges 3,4 can detect any movement of the iron.

Advantageously, as soon as movement is detected, the fan starts.

The second gauge 4 can detect movements in a plane parallel to that defined by the sole plate 2 (the ironing plane).

In an advantageous variant of the invention, the second gauge 4 can be connected to a steam generator in such a way that steam is produced when the iron is advancing but stops if the iron moves in another direction.

The first strain gauge 3 and the electronic circuit 7 are located inside a sleeve 8, while the second strain gauge 4 is arranged inside a block of plastic 9.

It should be noted that the strain gauges can act in combination.

Furthermore, they can simultaneously control the fan and the generation of steam.

It is also possible to provide the iron with buttons for manual control of the fan, steam generation or any other function of the iron. The buttons can also activate/deactivate the operation of the gauges.

It goes without saying that the invention is not limited to the examples discussed above. The possibility of connecting the strain gauges to the fan or to the generator has been described. They can of course be connected to other elements, such as the sole plate heater.

The invention claimed is:

1. A clothes iron comprising a sole plate (2) and a handle (1), characterized in that said handle (1) comprises a first strain gauge (3) arranged in a direction approximately parallel to the plane defined by the sole plate (2) and a second strain gauge (4) arranged in a direction forming an acute angle with the plane defined by the sole plate (2), said angle being open toward the front of the iron, in such a way that any movement of the iron activates at least one of said strain gauges (3, 4).

2. The clothes iron as claimed in claim 1, characterized in that the handle (1) has regions of greater flexibility (5, 6) at the positions where the strain gauges (3, 4) are located.

3. An ironing system comprising:

a clothes iron as described in claim 1, an ironing surface, and a fan located underneath the ironing surface in order to apply positive and/or negative pressure to a fabric laid on the ironing surface, the fan being connected electrically to the iron, and each of said strain gauges (3, 4) being connected to the fan in such a way that activation of at least one gauge (3, 4) will start the fan.

4. The ironing system as claimed in claim 3 comprising in addition a steam generator connected electrically and by a steam pipe to the iron, said second strain gauge (4) being connected to said generator in such a way that its activation causes steam to be produced.

5. The ironing system as claimed in claim 4, characterized in that the second strain gauge (4) allows the production of steam only when the iron is moving forward.

6. The ironing system as claimed in claim 4, characterized in that both strain gauges (3, 4) simultaneously control the fan and the production of steam.

7. The ironing system as claimed in claim 4, characterized in that the iron comprises at least one button for manual control of the fan, steam generation or any other function of the iron.

8. The ironing system as claimed in claim 7, in which said button is designed to activate/deactivate the operation of the strain gauges (3, 4).

* * * * *